US005723946A

United States Patent [19]

Park et al.

[11] Patent Number: 5,723,946

[45] Date of Patent: Mar. 3, 1998

[54] PLANE OPTICAL SOURCE DEVICE

[75] Inventors: Deuk-il Park, Seoul; Sang-mook Kim, Suwon, both of Rep. of Korea

[73] Assignee: Samsung Display Devices Co., Ltd., Kyungki-do, Rep. of Korea

[21] Appl. No.: 531,531

[22] Filed: Sep. 21, 1995

[30] Foreign Application Priority Data

Oct. 11, 1994 [KR] Rep. of Korea ..... 94-26116

[51] Int. Cl.[6] ..... H01J 61/30

[52] U.S. Cl. ..... 313/607; 313/491; 313/493; 313/631; 313/586

[58] Field of Search ..... 313/491, 493, 313/607, 631, 632, 586, 594, 601

[56] References Cited

U.S. PATENT DOCUMENTS

| | | | |
|---|---|---|---|
| 3,801,851 | 4/1974 | Andoh et al. | 313/586 |
| 3,896,327 | 7/1975 | Schermerhorn | 313/586 X |
| 4,112,329 | 9/1978 | Veith | 313/491 |
| 4,429,303 | 1/1984 | Aboelfotoh | 313/586 X |
| 5,150,011 | 9/1992 | Fujieda | 313/586 X |
| 5,182,489 | 1/1993 | Sano | 313/113 X |
| 5,343,114 | 8/1994 | Beneking et al. | 313/607 X |

FOREIGN PATENT DOCUMENTS

| | | | |
|---|---|---|---|
| 0121050 | 5/1993 | Japan | 313/607 |

*Primary Examiner*—Ashok Patel
*Attorney, Agent, or Firm*—Lowe, Price, LeBlanc & Becker

[57] ABSTRACT

A plane optical source device used in a rear illuminating optical source of a liquid crystal display device or for general illuminance is provided. The plane optical source device includes a container having a front plate, a rear plate and side walls, the front plate being made of a transparent substance, for defining an airtight space for generating arc; a fluorescent layer formed on the inner surface of the front plate; a first electrode formed on the inner surface of the rear plate of container in a predetermined pattern, the first electrode being opposite to the fluorescent layer; and a second electrode formed on the outer surface of the rear plate, corresponding to the first electrode.

8 Claims, 3 Drawing Sheets

PLANE OPTICAL SOURCE DEVICE

BACKGROUND OF THE INVENTION

The present invention relates to a plane optical source device, and more particularly, to a plane optical source device for illuminating as a result of exciting a fluorescent body by ultraviolet rays generated through electrical arcing.

Plane optical source devices are widely used in a rear-illuminating optical source of a liquid crystal display device, in an illuminating signboard which directly uses the optical source, and in a plane image display device such as a display panel.

FIGS. 1 and 2 show an example of a conventional plane optical source device. Here, separation walls 12 are provided inside an airtight container 11, to establish a space 13 for generating arc which can provide uniform illumination over a wide area by snaking across the entire area to be illuminated. Electrode members 14 and 14' are placed at both ends of space 13. A fluorescent layer 16 and a reflecting layer 17 are formed on the upper and lower inner surfaces of the container, respectively. Here, airtight container 11 is provided with a transparent top 11*a*.

According to the conventional plane optical source device having the above structure, when a predetermined electrical potential is applied to electrode members 14 and 14', arcing occurs in space 13, which produces illumination. Thus, fluorescent layer 16 is excited by the ultraviolet rays generated through the resulting spark, so that the fluorescent layer emits light. Such a device, however, has certain drawbacks.

First, since inter-electrode arcing follows the shortest path between electrode members 14 and 14', the illuminance is weak along the edges of the space in which the arcing is generated and especially weak at the corners thereof.

Second, the increased electrical distance between electrode members 14 and 14' requires a higher voltage to initiate arcing.

Third, the higher voltage required for arcing shortens the life span of the electrode members.

Fourth, the mere presence of separation walls 12 reduces the screen's effective area for illumination.

SUMMARY OF THE INVENTION

To solve the above problems, it is an object of the present invention to provide a plane optical source device in which even arcing can occur with a high degree of efficiency.

It is another object of the present invention to provide a plane optical source device in which arcing can occur at a lower voltage and a high level of illuminance can be obtained evenly.

To achieve the above objects, there is provided a plane optical source device comprising: a container having a front plate, a rear plate and side walls, the front plate being made of a transparent substance, for defining an airtight space for generating an arc; a fluorescent layer formed on the inner surface of the front plate; a first electrode formed on the inner surface of the rear plate of container in a predetermined pattern, the first electrode being opposite to the fluorescent layer; and a second electrode formed on the outer surface of the rear plate, corresponding to the first electrode.

It is preferable that the rear plate of the container is made of dielectric glass and the second electrode is made of a conductive reflecting layer.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
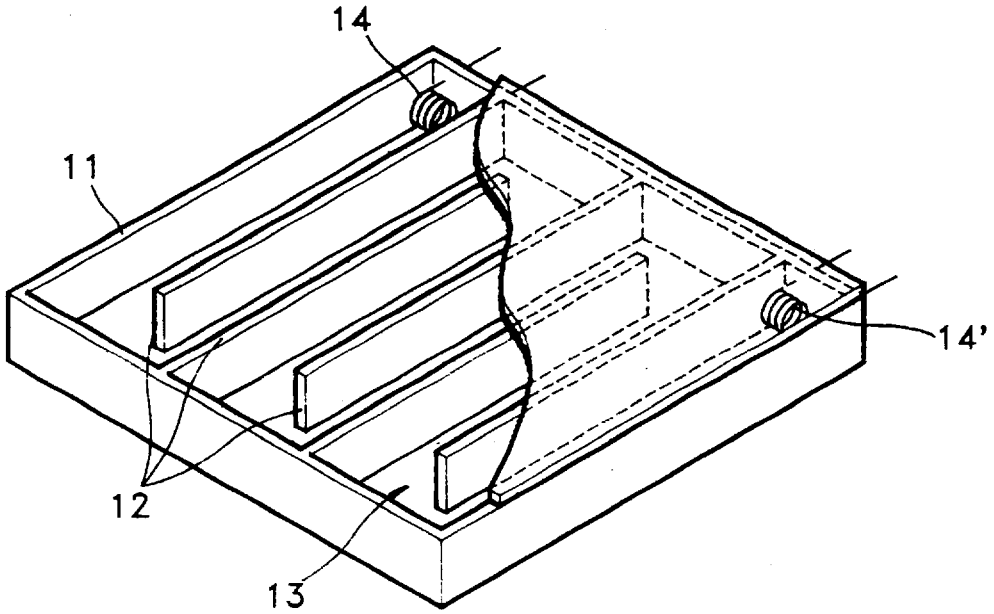
FIG.1(PRIOR ART)
FIG. 1 is a partially cut away perspective view of a conventional plane optical source device.
Figure 2:
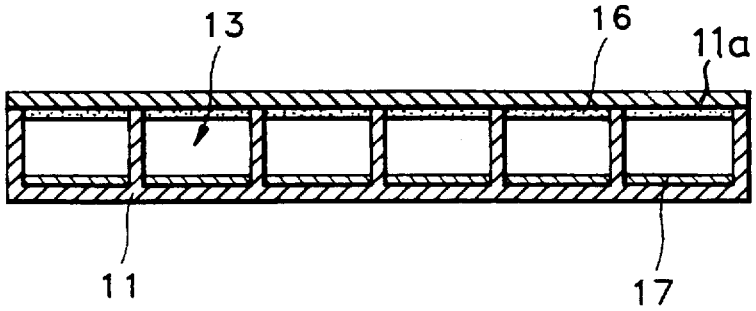
FIG.2(PRIOR ART)
FIG. 2 is a section view of the plane optical source device shown in FIG. 1.
Figure 3:
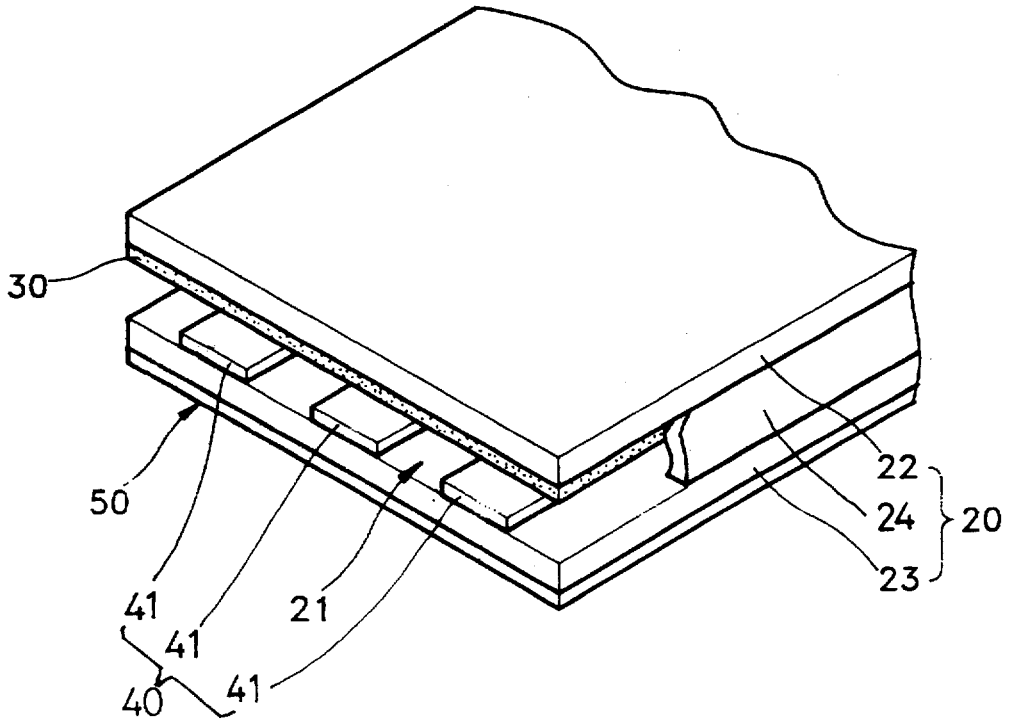
FIG. 3 is a partially cut away perspective view of a plane optical source device according to the present invention.

Referring to FIG. 3, the plane optical source device according to the present invention is made of transparent substance and composed of a container 20 defining a space 21 for generating an arc, a fluorescent layer 30 formed on the inner surface of a front plate 22 of container 20, a first electrode 40 formed on the inner surface of a rear plate 23 of container 20 and being opposite to fluorescent layer 30, and a second electrode 50 formed on the outer surface of rear plate 23 and being corresponding to first electrode 40.

Container 20 is formed by sealing the edges thereof for front and rear plates 22 and 23 which are transparent and spaced by a predetermined distance defined by the height of a side wall 24. Container 20 is made of dielectric glass. As the dielectric for forming container 20, ceramics may be used. Here, when selecting dielectric substance, the dielectric strength should be considered. When the dielectric strength exceeds, the dielectric substance starts to break down and a current, that is, the passage of electrons, is generated.

The electrical charge is stored in a capacitor formed of the dielectric substance forming container 20. The capacitance of parallel plane capacitor is calculated by $C=\epsilon S/d$, wherein $\epsilon$ represents a dielectric constant, S represents area and d represents the distance between plates. Thus, the capacitance can be varied according to distance d when the other condition is constant. As capacitance C is greater at the same voltage, the stored electricity amount is greater. However, since the dielectric generally has high resistance, there is no guarantee for the active sparking and much higher voltage is required for the sparking when the distance between the dielectric layers is long (that is, the thickness of container is thick). Thus, the plane optical source device according to the present invention can be designed to be proper for the various purposes by controlling required optical amount through the controlling of the container's thickness.

Figure 4:
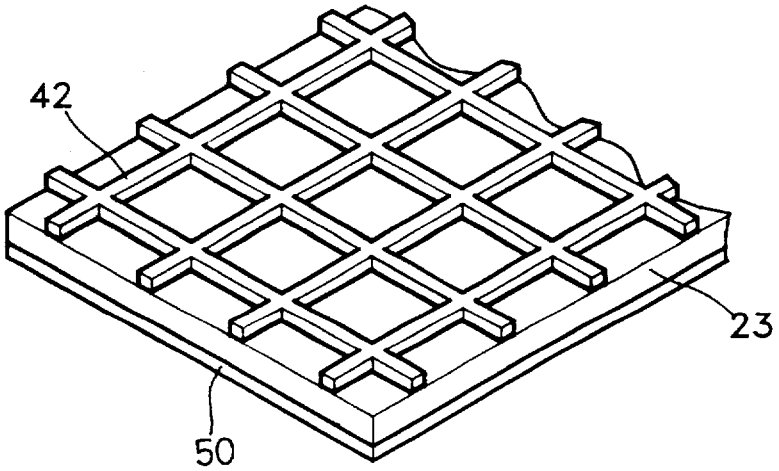
FIGS. 4 and 5 are extracted perspective views showing preferred embodiments of the first electrode of FIG. 3.
Figure 5:
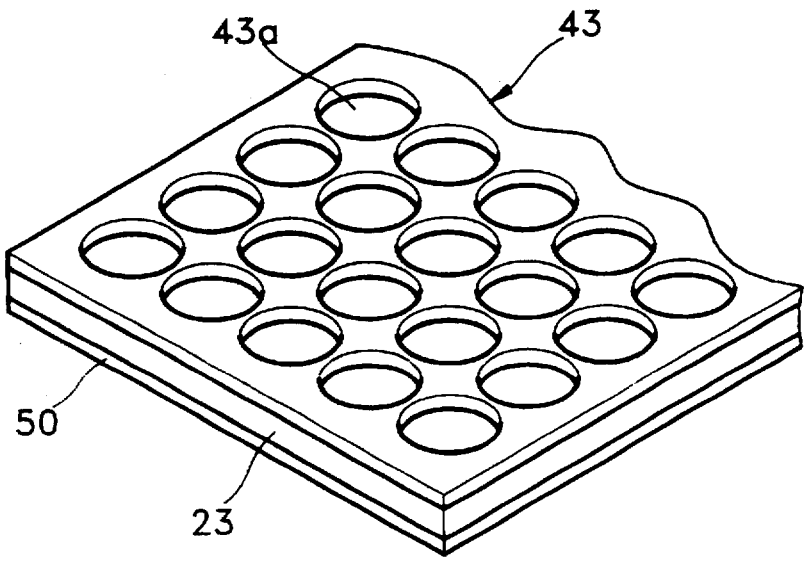

First electrode 40 placed inside container 20 made of the dielectric while being opposite to the fluorescent layer is composed of a plurality of conductive electrode members 41 which are spaced from each other by a predetermined distance and parallel with each other. As shown in FIG. 4 showing a preferred embodiment of the first electrode, an electrode member 42 may be formed in continuously arranged polygons. As shown in FIG. 5 showing another preferred embodiment of the first electrode, the first electrode may have a structure in which a plurality of apertures 43*a* through which the light may pass are formed on a plate conductive electrode member 43. The first electrode is not limited to the above preferred embodiments and can be modified to an arbitrary shape in that the inside of container 20 is exposed in a predetermined pattern.

Second electrode 50 is formed by attaching a metal plate to the outer surface of container 20 in which first electrode 40 is formed. Also, second electrode 50 may be formed by depositing metal such as aluminum on the outer surface of container 20. Here, it is preferable that second electrode 50 is made of aluminum plate.

A predetermined pulse voltage for sparking is applied to first and second electrodes 40 and 50 formed on the inner and outer surface of the container and rare gas and hydrogen gas are injected into container 20.

The operation of the plane optical source device according to the present invention having the above structure will be described below.

Figure 6:
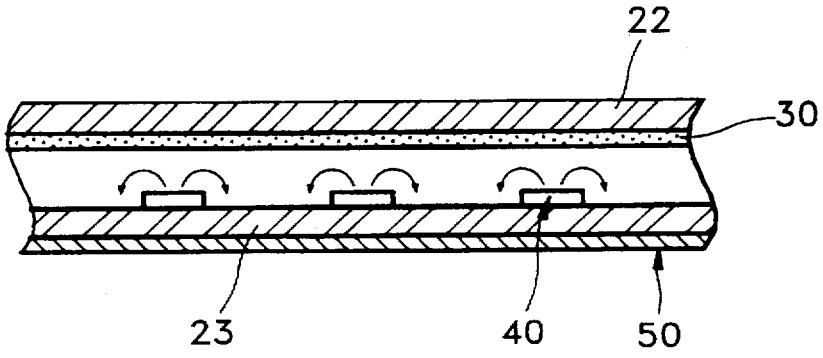
FIG. 6 is a partial section view of a plane optical source device according to the present invention.

To drive the plane optical source device according to the present invention, first, a predetermined frequency or pulse voltage is applied to first and second electrodes 40 and 50. As a result, electrons existing inside of the container having first electrode 40 are charged as shown in FIG. 6.

When the voltage applied to first electrode 40 is above a sparking initiation voltage, the glow sparking occurs between the charged electrons existing inside of container made of the dielectric and first electrode 40. When the glow sparking occurs, the accelerated electron excites mercury. The ultraviolet rays generated from mercury then excites the fluorescent body of fluorescent layer 30, to thereby emit light from the fluorescent body. Here, light generated from the fluorescent body of fluorescent layer 30 is irradiated to the front of container 20. Also, light irradiated to the rear of container 20 is reflected by second electrode 50 made of conductive reflecting layer and then irradiated to the front of container 20.

Since second electrode 50 is formed over whole outer surface of container 20 and first electrode 40 is formed on the inner surface of container 20 in stripe or continuously arranged polygons, the glow sparking generated between first and second electrodes 40 and 50 through the above process is even over whole rear plate 23, so that even illuminance can be obtained at each portion of illuminating region.

In addition, in the plane optical source device, if an opening ratio of first electrode 40 which is ratio between the electrode formation area and the exposed inside area of the container is controlled, the optical amount and the consumption of electric power can be reduced. That is, since a current density is current per area, the deterioration of electrode can be overcome and the life span thereof can be elongated by enlarging the area of first electrode 40 in the case of the same current.

As described above, in the plane optical source device according to the present invention, gas is excited by the glow sparking and the fluorescent body is then excited by ultraviolet rays emitted from the gas, to thereby emit light from the fluorescent body. As a result, relative illuminance is improved and the manufacturing cost is reduced due to the simple structure. Also, since the second electrode made of aluminum is placed on the outer surface of a rear plate, light generated from the fluorescent body is reflected, so that the optical loss can be reduced.

The plane optical source device according to the present invention can be widely used as an optical source of an illuminating signboard or various image displays including a liquid crystal device.

What is claimed is:

1. A plane optical source device comprising:

a container having a front plate, a rear plate and side walls, said front plate being made of a transparent substance, for defining an airtight space for generating an arc;

a fluorescent layer formed on the inner surface of said front plate, said fluorescent layer being in contact with substantially the entire inner surface of said front plate;

a first electrode formed on the inner surface of said rear plate of the container in a predetermined pattern, said first electrode being opposite to said fluorescent layer; and a second electrode formed on an outer surface of said rear plate, corresponding to said first electrode.

2. A plane optical source device as claimed in claim 1, wherein said rear plate of the container is made of dielectric glass.

3. A plane optical source device as claimed in claim 1, wherein said second electrode is made of aluminum so as to reflect light emitted from a fluorescent body.

4. A plane optical source device as claimed in claim 3, wherein said second electrode is formed by depositing aluminum on the outer surface of the rear plate of said container.

5. A plane optical source device as claimed in claim 1, wherein said first electrode is composed of a plurality of conductive electrode members in a striped pattern.

6. A plane optical source device as claimed in claim 1, wherein said first electrode is composed of conductive electrode member in continuously arranged polygons.

7. A plane optical source device as claimed in claim 1, wherein said first electrode is composed of a plurality of apertures through which light may pass.

8. A plane optical source device as claimed in claim 1, wherein said second electrode is in contact with substantially the entire outer surface of said rear plate.

* * * * *